US007472738B2

(12) United States Patent
Kamosawa et al.

(10) Patent No.: US 7,472,738 B2
(45) Date of Patent: Jan. 6, 2009

(54) SCREEN DEVICE

(75) Inventors: Yoji Kamosawa, Tokyo (JP); Hirotsugu Toda, Tokyo (JP); Mitsuhiko Chino, Tokyo (JP); Masato Moriya, Tokyo (JP)

(73) Assignee: Seiki Hanbai Co., Ltd., Tokyo (JP)

( * ) Notice: Subject to any disclaimer, the term of this patent is extended or adjusted under 35 U.S.C. 154(b) by 283 days.

(21) Appl. No.: 10/562,660

(22) PCT Filed: Jun. 29, 2004

(86) PCT No.: PCT/JP2004/009154

§ 371 (c)(1),
(2), (4) Date: Dec. 29, 2005

(87) PCT Pub. No.: WO2005/001230

PCT Pub. Date: Jan. 6, 2005

(65) Prior Publication Data

US 2006/0162871 A1 Jul. 27, 2006

(30) Foreign Application Priority Data

Jun. 30, 2003 (JP) ..... 2003-188212
Jul. 15, 2003 (JP) ..... 2003-274927

(51) Int. Cl.
*A47H 5/00* (2006.01)
*A47H 1/00* (2006.01)
*A47G 5/02* (2006.01)

(52) U.S. Cl. ..... 160/84.06; 160/31; 160/243; 160/245

(58) Field of Classification Search ..... 160/31, 160/84.04–84.06, 194, 201, 240, 264, 268.1, 160/271, 272, 277, 279, 242, 243, 245, 273.1, 160/269

See application file for complete search history.

(56) References Cited

U.S. PATENT DOCUMENTS 5,873,401 A * 2/1999 Tsuchida ..... 160/84.04
6,059,007 A * 5/2000 Tomita ..... 160/242
6,186,212 B1 * 2/2001 Tsuchida ..... 160/84.06
6,318,438 B1 * 11/2001 Uno et al. ..... 160/31

FOREIGN PATENT DOCUMENTS

JP 08121054 * 5/1996
JP 2000-352280 12/2000
JP 2001-248370 9/2001
WO 03/038226 5/2003

OTHER PUBLICATIONS

U.S. Appl. No. 10/557,844, filed Nov. 21, 2005, Chino, et al.
U.S. Appl. No. 10/562,660, filed Dec. 29, 2005, Kamosawa, et al.

* cited by examiner

*Primary Examiner*—Katherine W Mitchell
*Assistant Examiner*—Jeremy C Ramsey
(74) *Attorney, Agent, or Firm*—Oblon, Spivak, McClelland, Maier & Neustadt, P.C.

(57) ABSTRACT

A screen device including a screen guide that has a simple structure, stably operates, and, in a guided-out state, can be formed in a straight rail-like shape. A screen guide of the screen device includes a large number of guide pieces, each formed in an approximately U-shape by a bottom and standing walls respectively extending along the end of a screen and the external side surfaces of the screen, and having a structure in which passage holes are formed along the tops of the standing walls, two strings of wire members are exerted through the respective passage holes, and, when the screen guide is guided out along the end of the screen, the serial contact surfaces of the adjacent guide pieces abut against each other.

11 Claims, 18 Drawing Sheets

SCREEN DEVICE

TECHNICAL FIELD

The present invention relates to a screen device including a screen guide configured to guide the end of a screen, extending along its open-close direction, and more particularly, with respect to a screen, e.g., a fitting such as a screen door, a partition, or a curtain, it relates to a screen device including a screen guide configured to, in response to an open-close operation of the screen, crookedly move in and out the inside of at least one of frame members fixed to both ends of the screen in its open-close direction, and be guided out along the end of the screen lying in a tension state so as to guide the end.

BACKGROUND ART

A screen device including a screen guide configured to guide the end of a screen has a structure in which, in response to an open-close operation of the screen, the screen guide crookedly moves in and out the inside of at least one of frame members fixed to both ends of the screen in its open-close direction and is guided out along the end of the screen lying in a tension state so as to guides the end of the screen. For example, a screen device including a slide-guide frame-section disclosed in Patent document 1 is known. In the known screen device, by connecting rigid units one another, each including sidewalls facing each other, having a bridge section interposed therebetween, the slide-guide frame-section is formed.

Unfortunately, the screen device set forth in the foregoing Patent document 1 has disadvantages that, since the rigid unit constituting the slide-guide frame-section serving as a screen guide has a complicated structure, resulting in increase in not only its manufacturing cost but also time and effort for connecting the rigid units one another. Also, the complicated structure causes increase in time and effort for maintaining the slide-guide frame section. In addition, since the rigid units are rotatably connected one another, these units generate noises upon coming into contact with a floor surface and a frame member, hence, the screen device has no hope of achieving a quiet and stable open-close operation of the screen.

In order to solve the foregoing problems, Patent document 2 discloses a screen device including a screen guide (a net guide) configured to move in and out the insides of frame members fixed to both ends of a screen from the respective lower ends, in response to an open-close operation of the screen (net), and be guided out along the lower end of the screen lying in a tension state so as to guide the lower end.

The screen device disclosed in the foregoing Patent document 2 has very effective advantages that, since a reaction force due to curving of a tape-shaped member of the net guide, occurring at a serial contact portion of guide pieces, serves as an acting force for a buffer against an operating force of a movable edge member, by providing a buffer property with an appropriate resistance, noises can be prohibited without deteriorating the open-close operability of the movable edge member, and, besides, the net guide can be offered with a simple structure and at low price.

Whereas, when an external force such as an unexpected strong wind is exerted on the net, a portion of the net guide, linearly guided out from the frame member, is pressed against the lower end of the net, and the net guide can be curved in the horizontal lateral direction.

Also, while the tape-shaped member serially connecting the respective guide pieces is configured to prohibit the net guide from curving in the reverse direction (raising from the floor surface), when the net is stretched over a relatively wide range, that is, when the net is retracted by the movable edge member with a strong force in a state in which the net guide is guided out relatively long, a large force is acted on the net guide in a direction to be guided into the frame member, whereby the net guide can curve in the lateral direction, or, contrary to the normal case, partially raised while curving upwards in a projecting manner. Hence, taking measures for preventing the net guide from curving in the reverse direction is desired.

Patent document 1: Japanese Unexamined Patent Application Publication No. 1: 2000-145314

Patent document 2: Japanese Unexamined Patent Application Publication No. 2: 2003-161089

DISCLOSURE OF INVENTION

A technical subject of the present invention is to provide a screen device including a screen guide that has a simple structure, stably operates, and, in a guided-out state, is formed in a straight rail-like shape.

Also, another technical subject of the present invention is to provide a screen device including a screen guide which, in a simple form, can be prevented from curving in the horizontal lateral direction and bending in a reverse direction (raising from an installation surface) and always stably guide the end of the screen.

In order to solve the foregoing subjects, a screen device according to the present invention includes a screen guide allowing a stretchable screen to open and close and configured to, in response to an open-close operation of the screen, crookedly move in and out the inside of at least one of frame members fixed to both ends of the screen in its open-close direction and be guided out along the end of the screen lying in a tension state so as to guide the end, wherein the screen guide includes a large number of guide pieces composed of a synthetic resin, each formed in an approximately U-shape by its bottom and standing walls respectively extending along the end of the screen and the external side surfaces of the screen and having a structure in which passage holes are formed along the tops of the standing walls, two strings of wire members are exerted through the respective passage holes of the guide pieces, and the tops of the standing walls on the serial contact surfaces of the guide pieces are thus rotatably serially contacted with one another, and, when the screen guide is guided out along the end of the screen, a part of or all the serial contact surfaces of the adjacent guide pieces abut against each other.

In the screen device according to the present invention, grooves allowing the wire members to be fitted therein and out are provided along the passage holes of the standing walls, thereby achieving easy attachment and detachment of each guide piece for its assembly, replacement, and the like, and also, intermediate rotors are interposed between the passage holes of the adjacent guide pieces, allowing the wire members to pass therethrough, thereby achieving smooth crooking between the guide pieces.

In addition, a part of or all the guide pieces may include engagements slidably engaging with a guide rail provided on the sliding surfaces thereof.

In the screen device according to the present invention, the screen is preferably formed in an accordion-like shape so as to be extendable while being alternately folded back and forth or a flexible sheet-like member wound around a roller. In these cases, when the screen is composed of a fly net, the screen device serves as a screen door.

Also, if the screen is formed in an accordion-like shape while being alternately folded back and forth, the screen guides may be configured to move in and out the insides of the frame members fixed at both ends of the screen in its open-close direction.

Further, in the screen device according to the present invention, the screen is preferably openable by horizontal drawing. On that occasion, the screen is provided so as to be openable by horizontal drawing, and the screen guides are provided along both upper and lower side ends of the screen if needed.

Also, if the screen is openable by horizontal drawing, one end of a tension string for achieving a parallel translation of a movable frame used for an open-close operation of the screen is connected to the screen guide so as to configure the parallel translation mechanism of the frame member with the screen guide and the tension string.

With the screen device according to the present invention, the screen guide has a simple structure in which the passage holes are formed along the tops of the standing walls of the guide piece constituting the screen guide and the two strings of the wire members are inserted through the passage holes, thereby not only offering a screen guide at low price but also achieving its easy assembly as well as improving its maintainability. In addition, the screen guide has a crooking portion provided at the upper parts of the standing walls of the guide piece (on the inner side of a crooked shape), thereby preventing parts of adjacent guide pieces from overlapping with each other. Also, the passage holes are formed in two strings of groove-like shapes when the screen guide extends in a straight pattern, thereby achieving a stable guide for an open-close operation of the screen.

Besides, when guided along the end of the screen, the screen guide is configured such that all or parts of serial contact surfaces of the adjacent guide pieces abut against each other, thereby preventing the screen guide from curving in the horizontal lateral direction of the screen and crooking in the reverse direction (raising from an installation surface). In addition, since the guide piece can be formed in a square or rectangular shape in side view, in a state of being guided-out, the screen guide can be formed in a straight rail shape having no undulations on its upper edge, resulting in not only a neat external appearance but also no problem of being caught with other objects (a screen and the like), thereby achieving a more stable open-close operation of the screen.

REFERENCE NUMERALS

Figure 1:
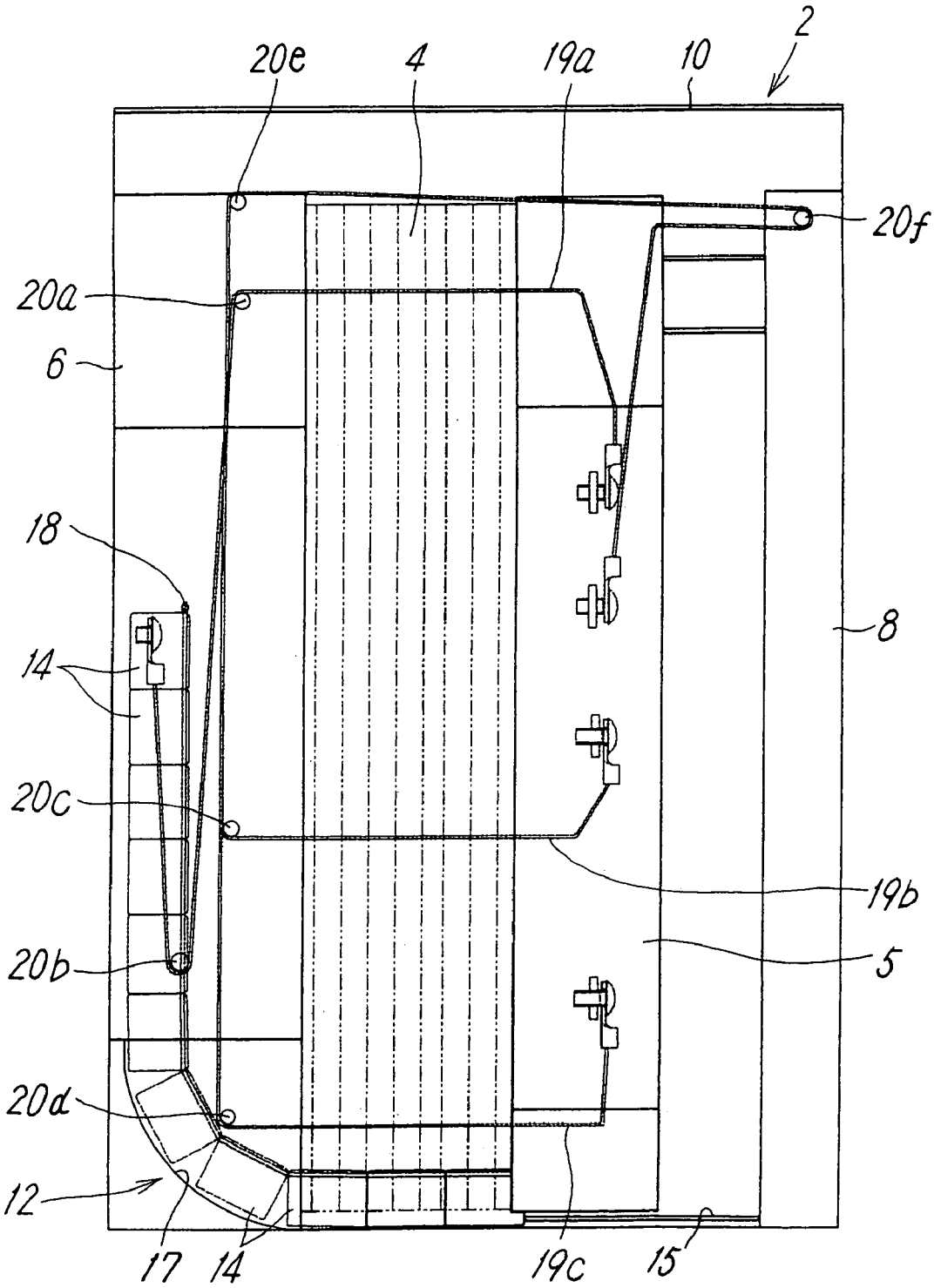
FIG. 1 is an elevational view of the overall structure of an accordion-shaped horizontal-drawing screen door according to a first embodiment of the present invention.

2 screen-door frame
4, 31 fly net (screen)
5, 5M, 5N movable edge member (frame component)
6, 6M, 6N vertical frame member (frame component)
8 vertical frame member
10 horizontal frame member
12, 12A, 12B, 12N net guide (screen guide)
14, 14N, 141, 142, 143 guide piece
14*a*, 141*a*, 142*a*, 143*a* bottom
14*b*, 141*b*, 142*b*, 143*b* standing walls
14*c*, 141*c*, 142*c*, 143*c* passage holes
14*d* serial contact surfaces
14*f* abutments
15 guide rail
16 wire members
19*a* to 19*c*, 191*a* to 191*c*, 192*a* to 192*d*, 193*a* to 193*d*, 194*a* to 194*c*, 195*a* to 195*b*, 196*a* to 196*b*, 197*a* to 197*c* tension string
21 intermediate rotors
141*f*, 142*f* grooves

BEST MODE FOR CARRYING OUT THE INVENTION

Figure 2:
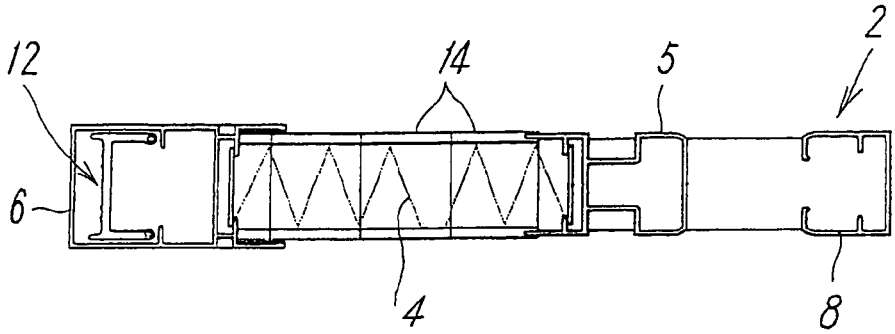
FIG. 2 is a sectional plan view of FIG. 1.
Figure 3:
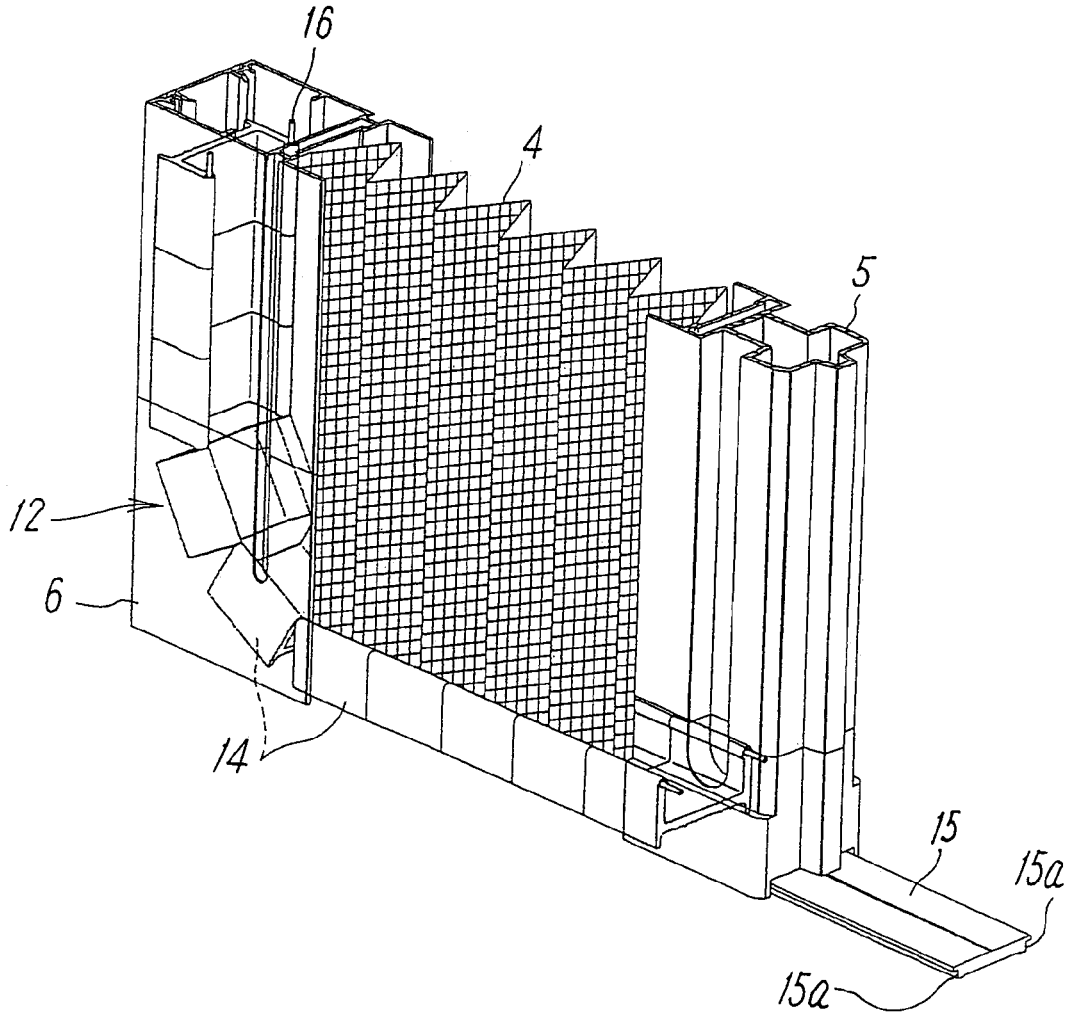
FIG. 3 is broken perspective view of an essential part of the structure of the horizontal-drawing screen door shown in FIG. 1.

FIGS. 1 to 3 illustrate a screen device according to a first embodiment of the present invention, configured to serve as an accordion-shape horizontal-drawing screen door to be installed at an opening of a building.

The horizontal-drawing screen door general includes a screen-door frame 2, a fly net 4 serving as a screen, openably fixed within the screen-door frame 2 by horizontal drawing, and a movable edge member 5 fixed to one end of the net 4, used for an open-close operation. The screen-door frame 2 includes right and left vertical frame members 6 and 8 and an upper horizontal frame member 10, and has a net guide (screen guide) 12 disposed at the lower part thereof and configured to guide the lower end of the net 4, so as to come in and out the vertical frame member 6 in accordance with movement of the movable edge member 5.

In the meantime, in FIGS. 1 and 3, for the sake of clarification of the drawings, the internal structures of the movable edge member 5 and the vertical frame members 6 and 8 are also indicated with a solid line. The same way of drawing is applied to other drawings except for a part of the drawings.

The foregoing net guide 12 is fixed to the lower end of the movable edge member 5 at one end thereof, crookedly moves in and out the inside of the vertical frame member 6 in response to extension and contraction of the net 4 in accordance with movement of the movable edge member 5. Upon extending the net 4, the net guide 12 is guided out along the lower end of the net 4 lying in a tension state and, by holding the ends of them, prevents the lower end of the net 4 from swaying due to an external force such as a wind.

Figure 4:
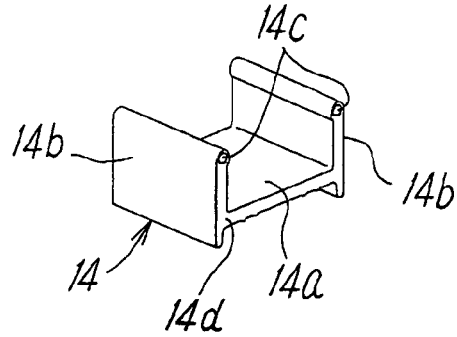
FIG. 4 is a perspective view of a guide piece of a net guide constituting the first embodiment.
Figure 5:
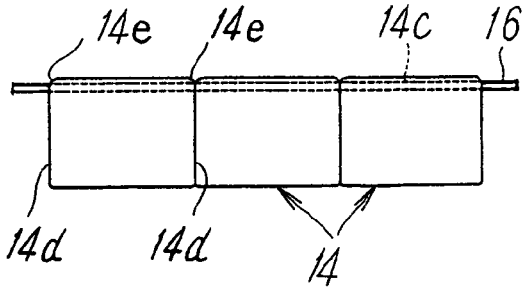
FIG. 5 is a partial side view of the net guide in which the guide pieces shown in FIG. 4 are serially contacted with one another.
Figure 6:
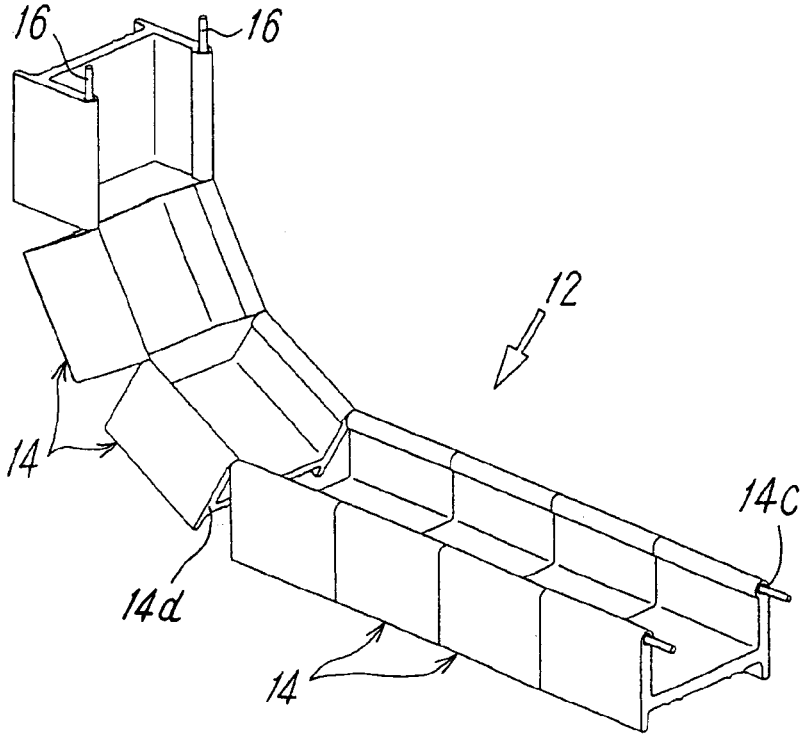
FIG. 6 is a perspective view of a bending state of the net guide in which the guide pieces shown in FIG. 4 are serially contacted with one another.

More particularly, as shown in FIGS. 4 to 6, the net guide 12 is configured such that a large number guide pieces 14 composed of a synthetic resin are connected to one another by two strings of flexible wire members 16.

As clearly shown in FIG. 4, the guide piece 14 constituting the net guide 12 is formed in an U-shape by a bottom 14*a* extending along the lower end of the net 4 and a pair of standing wall 14*b* rising along both external side surfaces of the net 4 and has passage holes 14*c* disposed along the tops (the ends on the opening side) of the standing walls 14*b* thereof, allowing two strings of the wire members 16 to extend therethrough. The guide pieces 14 are rotatably serially contacted with one another by arranging the wire members 16 to extend through the passage holes 14*c* thereof, and, by providing stop members 18 (see FIG. 1) at the ends of the respective wire members 16 and the external side ends of the guide pieces 14 located at both ends of the net guide 12, each guide piece 14 is prevented from exiting from the wire members 16.

Since these guide pieces 14 are serially contacted with one another by arranging serial contact surfaces 14*d* thereof, each serving as an end face of the standing wall 14*b*, to abut against one another, the length of the wire member 16 can be substantially the same as the actual length of the large number of serially connected guide pieces 14, however, the wire member 16 is preferably formed so as to have a length having an allowance needed for crooking and an smooth operation of net guide 12, that is, slightly greater than the actual length of the large number of serially connected guide pieces 14.

The standing walls 14*b* of each guide piece 14 can be provided with fine cuts 14*e* at which, when the net guide 12 crooks, the tops of the standing walls 14*b* of the mutually adjacent guide pieces 14 abut against each other. With this, the net guide 12 can be crooked without arranging the wire members 16 to have an allowance so as to make a gap between the adjacent guide pieces 14.

While the wire member 16 constituting the net guide 12 is can be composed of a material so as to achieve very easy crook, it can be also formed so as to achieve a reaction force of the order of an acting force, serving as a buffer against an operating force of the movable edge member 5. From such a viewpoint, an appropriate degree of elasticity or flexibility is needed to provide to the wire member 16 of the net guide 12, for example, by selecting its material or adjusting its size.

As the wire member 16, a part of a tension string configuring a parallel translation mechanism of a movable edge member, which will be described later, provided for an open-close operation of the net 4 can be used.

As described above, the net guide 12 is configured to, in accordance with an open-close operation of the net 4, crookedly move in and out the inside of the vertical frame member 6 constituting the screen-door frame 2 from its lower end, and to guide the lower end of the net 4 through its guiding out operation. By arranging the end of the side of the net guide inserted in the vertical frame member 6 to remain in the vertical frame member 6 even in a full tension state of the net 4, the net guide 12 can be smoothly guided in and out the inside of the vertical frame member 6 without especially providing a guide for crooking the net guide 12, however, if needed, a guide surface 17 allowing the net guide to crook can be provided at its crooking place.

The net 4 serving as the screen is configured to be extendable in an accordion pattern by providing it a large number of pleats in a zigzag pattern by folding it alternately back and forth, have the vertical frame member 6 and the movable edge member 5, used for an open-close operation of the net 4, of the screen-door frame 2 fixed to both ends thereof, and open-close in response to an operation of the movable edge member 5. While the net 4 is illustrated as an example of a screen, one skilled in the art will appreciate that the present invention is not limited to such a net.

With this structure, upon opening and closing the net 4 by operating the movable edge member 5 fixed to the one end of the net 4, used for an open-close operation, the net guide 12 crooks at the tops of the standing walls 14*b* of the guide pieces 14, whereby the standing walls 14*b* of the adjacent guide pieces 14 have no overlapped portion upon crooking of the net guide 12, in other words, the guide piece 14 does not need to have a recess, as needed in a known net, for accommodating the standing wall 14*b* of the adjacent guide piece 14 provided to the standing wall 14*b* thereof, thereby achieving a smooth crooking operation of the net guide 12, e.g., a smooth open-close operation of the net 4.

In order to stably translate the movable edge member 5 fixed to the one end of the net 4, the movable edge member 5 has the parallel translation mechanism provided thereto. The parallel translation mechanism here is configured by stretching three tension strings 19*a* to 19*c* between the screen-door frame 2 and the movable edge member 5 and between the net guide 12 and the movable edge member 5.

The first tension string 19*a* has its one end fixed to the upper part of the movable edge member 5, horizontally extends through the net 4 from the vicinity of the upper end of the movable edge member 5 up to the inside of the vertical frame member 6, is guided in the vertical frame member 6, turned downwards in the vertical frame member 6 by a turning piece 20*a*, then, is wound up on a turning piece 20*b* disposed at the lower part of the vertical frame member 6 so as to be guided upwards in the vertical frame member 6, and connected to the guide piece 14 located at the front of the side of the net guide 12, configured to be guided in and out the inside of the vertical frame member 6.

At the same time, the second and third tension strings 19*b* and 19*c* have one ends respectively fixed to the central and lower parts of the movable edge member 5, horizontally extend through the net 4 up to the inside of the vertical frame member 6, are guided in the vertical frame member 6, respectively turned by turning pieces 20*c* and 20*d* so as to be guided in the vertical frame member 6 and up to the inside of the upper horizontal frame member 10, turned by a turning piece 20*e* so as to be guided in the horizontal frame member 10 to the upper end of the vertical frame member 8, wound up on a turning piece 20*f* located at the upper end of the vertical frame member 8 so as to be turned back in the horizontal frame member 10, and then, connected to the movable edge member 5.

Since, when the tension strings 19*a* to 19*c* as described above are stretched, the attitude of the movable edge member 5 is constraint with these strings, and, even when a force for an open-close operation is exerted on an arbitrary position of the movable edge member 5, the movable frame is driven to open and close while always keeping its attitude. Also, in a section of the tension section of the net 4, allowing the foregoing tension strings 19*a* to 19*c* to horizontally extend therethrough, the tension strings 19*a* to 19*c* prevent warp of the net 4, thereby achieving a stable tension state of the net 4.

As each of the turning pieces 20*a* to 20*f*, a sliding member composed of a synthetic resin, having a small frictional resistance against the tension strings 19*a* to 19*c* or a pulley is available. This applies to each of other embodiments, which will be described later.

In place of the foregoing net guide (screen guide) 2, other net guides having guide pieces as shown in FIGS. 7 to 10 connected one another are also available.

Figure 7:
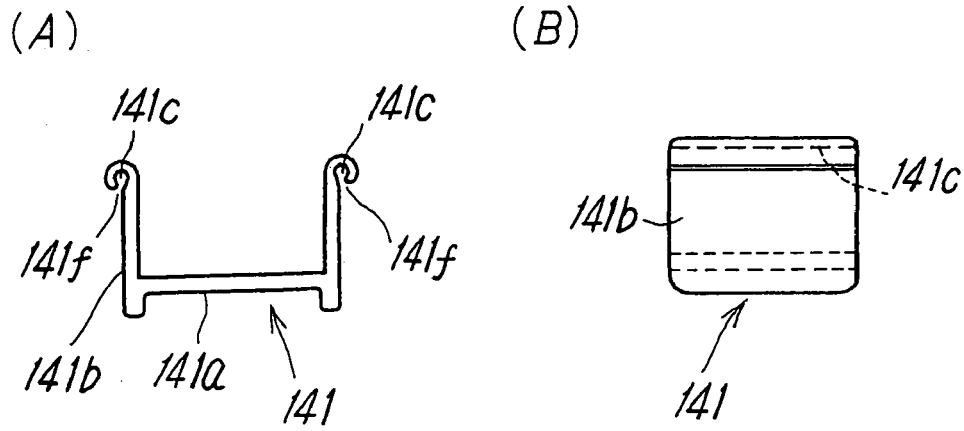
FIGS. 7(A) and (B) are respectively an elevational view and a side view of an example structure of another guide piece of the net guide.
Figure 8:
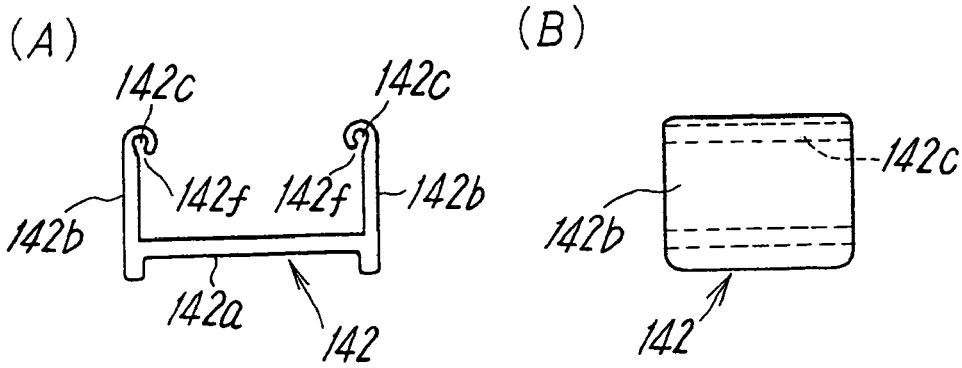
FIGS. 8(A) and (B) are respectively an elevational view and a side view of an example structure of another guide piece of the net guide.

A guide piece 141 shown in FIG. 7 has grooves 141*f* formed outside the tops of standing walls 141*b* standing at both sides of a bottom 141*a* of the guide piece 141 and along passage holes 141*c* located within the tops of the standing walls so as to allow the wire members 16 to be fitted therein and out. At the same time, a guide piece 142 shown in FIG. 8 has grooves 142*f* formed within the topes of standing walls 142*b* standing at both sides of a bottom 142*a* of the guide piece 142 and along passage holes 142*c* located within the tops so as to allow the wire members 16 to be fitted therein and out. Each of the grooves 141*f* and 142*f* has a width to an extent to which the wire member 16 can be fitted therein and out by exerting a certain force on the wire member 16. While these guide pieces 141 and 142 constitute the net guides by inserting two strings of the wire members 16 into these passage holes 141*c* and 142*c* in the same fashion as the guide piece 14 illustrated in FIGS. 4 to 6, with the grooves 141*f* and 142*f*, the wire member can be easily attached and detached for assembly and replacement of the guide pieces.

Figure 9:
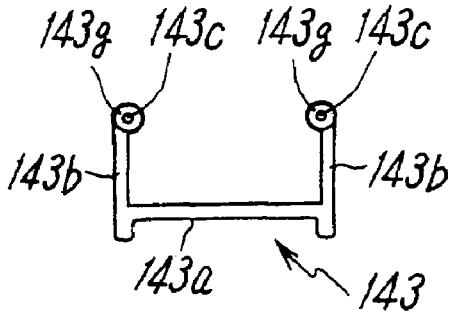
FIG. 9 is an elevational view an example structure of another guide piece of the net guide.
Figure 10:
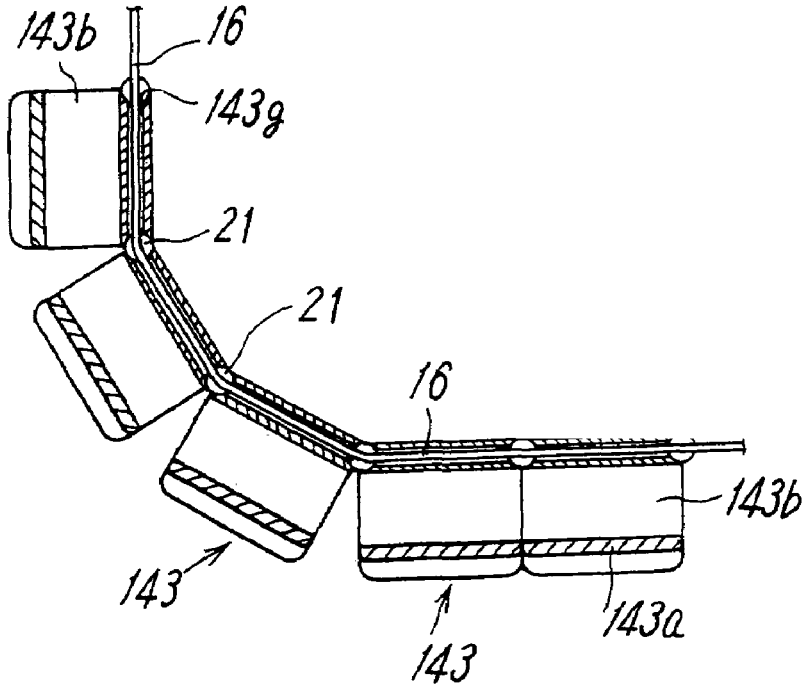
FIG. 10 is a sectional side view of a bending state of the net guide in which the guide pieces shown in FIG. 9 are serially contacted with one another.

Also, a guide piece 143 shown in FIG. 9 is configured to constitute another net guide as shown in FIG. 10. In order to have intermediated rotors 21, composed of approximately spherical beads, interposed between passage holes 143*c* for allowing two strings of the wire members 16 to extend therethrough, disposed at the tops of standing walls 143*b* located at both sides of each of bottoms 143*a* of the adjacent guide pieces 143, the guide piece 143 has depressions 143*g* disposed at the entrances of the passage holes 143*c*, for holding the intermediate rotors 21, and a large number of the guide pieces 143 are thus serially contacted with one another in a pattern shown in FIG. 10. The net guide configured by these guide pieces 143 achieves smooth crooking between the guide pieces 143.

Figure 11:
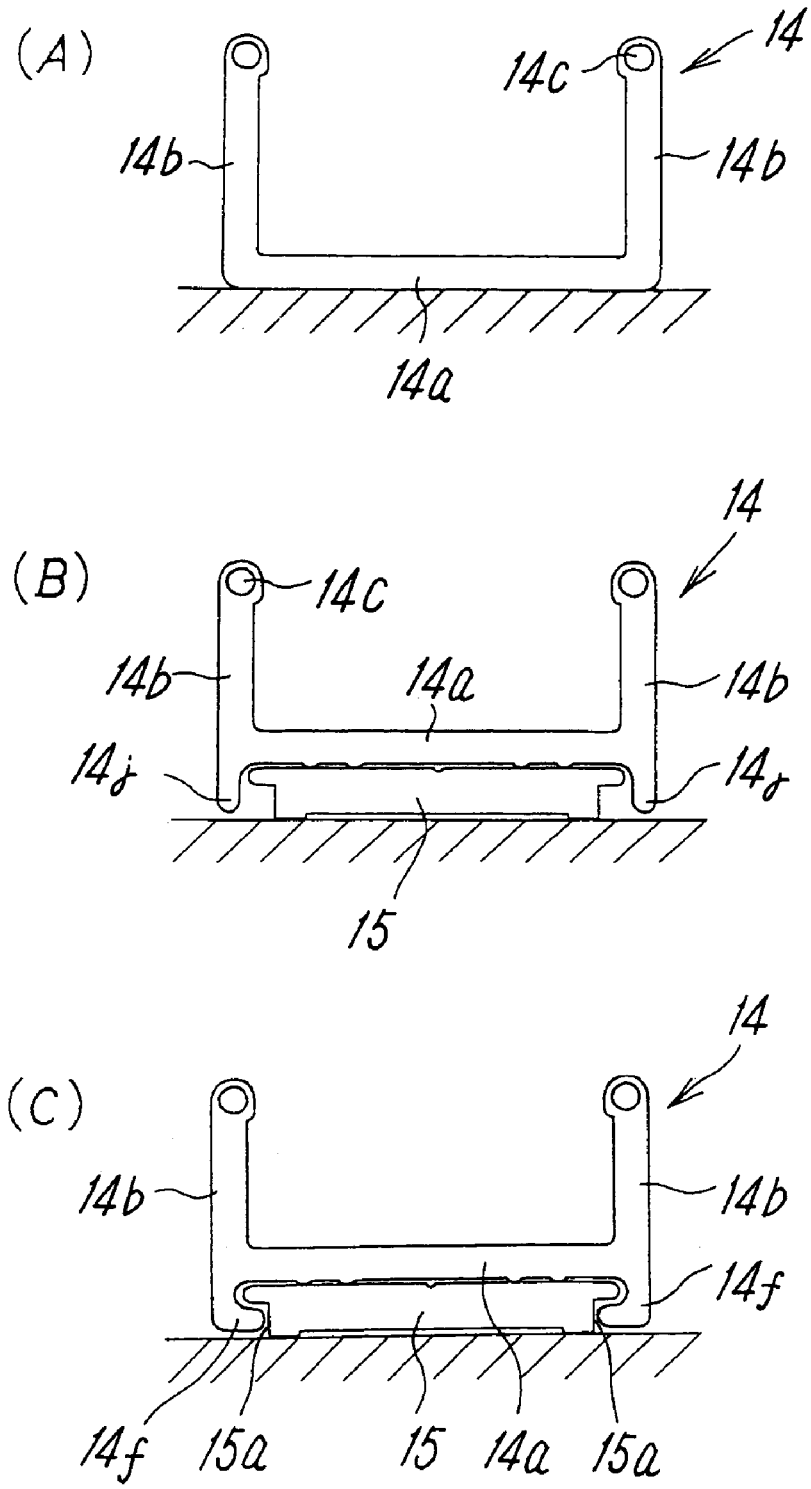
FIGS. 11(A) to (C) are elevational views of modifications of the installation surface of the guide piece shown in FIG. 4.

The guide piece of each of the foregoing net guides can be formed so as to have any one of installation structures as shown in FIGS. 11(A) to (C), depending on a relationship with a floor surface or the like of an opening of a building.

The guide piece 14 shown in FIG. 11(A) is configured to slide on a flat installation surface by arranging the under surface of its bottom 14*a* to be flat. The guide piece 14 shown in FIG. 11(B) is that shown in FIGS. 4 to 6 and, in order to move astride on a low guide rail 15 installed on the installation surface and having a height of about 2 to 3 mm (see FIGS. 1 and 3), has a pair of short legs 14*j* projecting downward from both standing walls 14*b* so as to be guided along the guide rail 15 with the short legs 14*j*. In addition, the guide piece 14 shown in FIG. 14(C) has mutually facing hook-shaped engagements 14*f* disposed at the bottom surface of the bottom 14*a*, and, by fitting the engagements 14*f* in depressed grooves 15*a* on both sides of the guide rail 15, the net guide is more stably guided and hence prevented from being raised. The engagements 14*f* can be formed in all or a part of the guide pieces.

Also, while all serial contact surfaces of each of the guide pieces 14, 141, 142, and 143 with those of the adjacent guide pieces have a flat shape so as to fully abut against each other, the serial contact surfaces are not needed to fully abut against each other and can be arranged so as to partially abut against each other as long as the mutually adjacent guide pieces 14, 141, 142, or 143 have constant abutment attitudes.

The foregoing net guide is usable not only in the horizontal-drawing screen door as shown in FIGS. 1 to 3 but also in a typical screen device, other than in a variety of screen doors, which will be described later.

Figure 12:
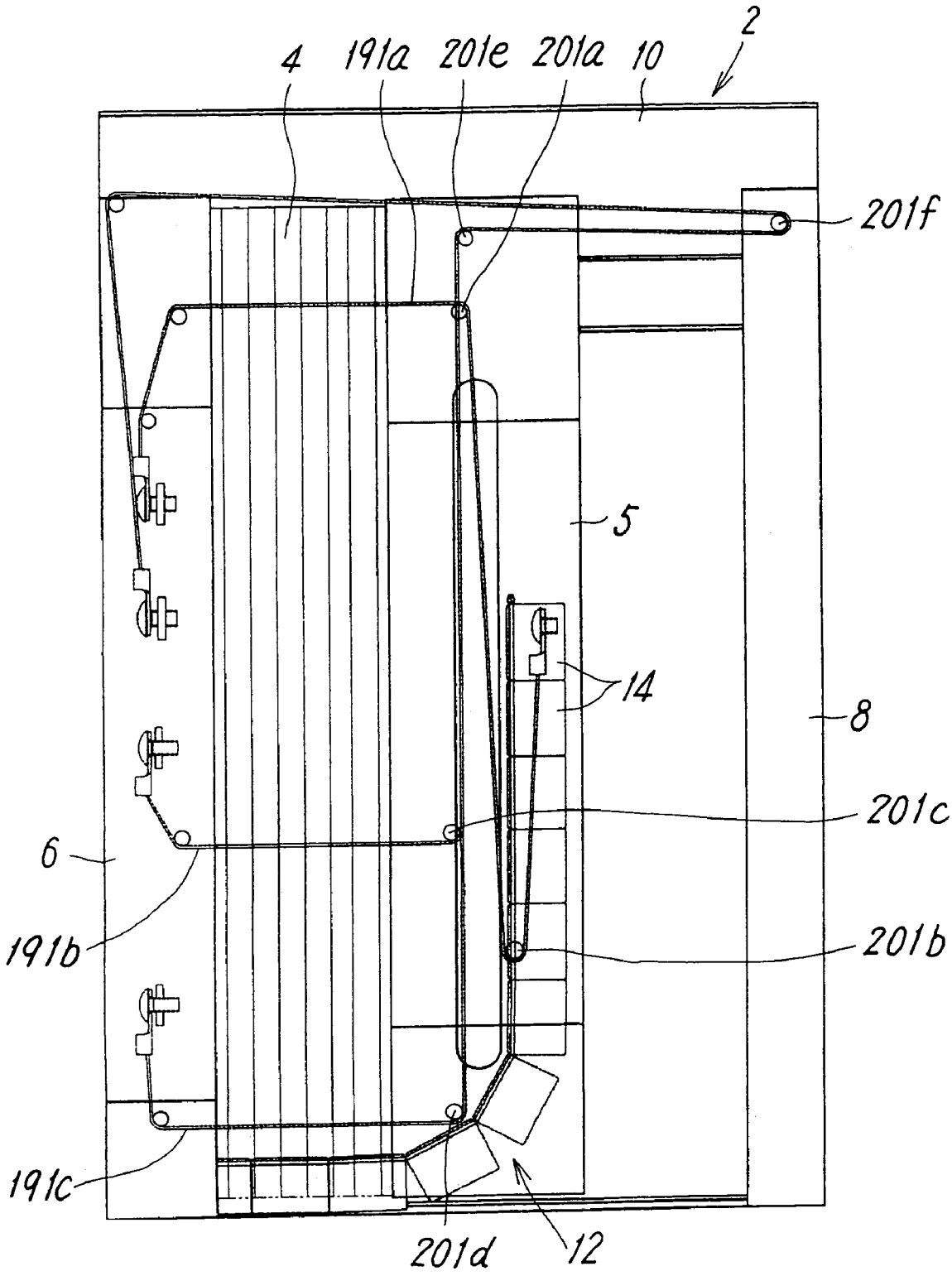
FIG. 12 is an elevational view of the overall structure of a horizontal-drawing screen door according to a second embodiment of the present invention.
Figure 13:
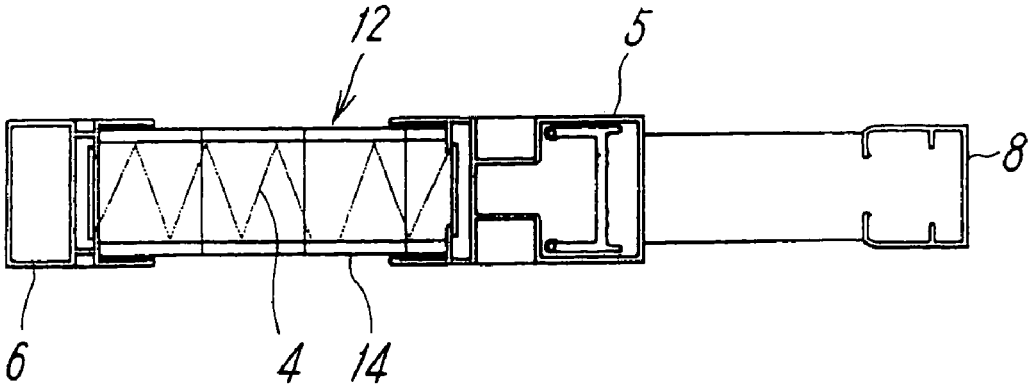
FIG. 13 is a sectional plan view of FIG. 12.

FIGS. 12 and 13 illustrate a horizontal-drawing screen door according to a second embodiment, having a structure in which one end of the net guide 12 is fixed to the lower end of the vertical frame member 6 having the one end of the net 4 fixed thereto, and the net guide 12 moves in and out the inside of the movable edge member 5 from its lower end in accordance with movement of the movable edge member 5. The net guide 12 itself can employ any one of the foregoing structures.

In the horizontal-drawing screen door according to the second embodiment, a parallel translation mechanism similar to the parallel translation mechanism of the first embodiment, employing three tension strings 191*a* to 191*c* is provided.

The first tension string 191*a* has its one end fixed to the upper part of the vertical frame member 6 having the net 4 fixed thereto, extends through the net 4 so as to be guided to the inside of the movable edge member 5, then, is guided downwards in the movable edge member 5 by a turning piece 201*a*, wound up on a turning piece 201*b* provided at the lower part of the movable edge member 5 so as to be guided upwards again in the movable edge member 5, and connected to the guide piece 14 located at the front of the net guide 12 configured to be guided in and out the movable edge member 5.

At the same time, the second and third tension strings 191*b* and 191*c* have one ends respectively fixed to the central and lower parts of the vertical frame member 6, extend through the net 4 so as to be guided in the movable edge member 5, then, are turned respectively by turning pieces 201*c* and 201*d* so as to be guided upwards in the movable edge member 5, guided to the inside of the upper horizontal frame member 10, extend through the horizontal frame member 10 by a turning piece 201*e*, are guided to the upper end of the vertical frame member 8, wound up on a turning piece 201*f* provided at the upper part of the vertical frame member 8, guided in the horizontal frame member 10 in the reverse direction, and subsequently, guided to the upper end in the vertical frame member 6 so as to be connected thereat.

When the tension strings 191*a* to 191*c* as described above are stretched, the attitude of the movable edge member 5 is constrained by them, hence, even when a force for an open-close operation is exerted on any position of the movable edge member 5, it is driven for an open-close operation while always keeping its attitude.

Figure 14:
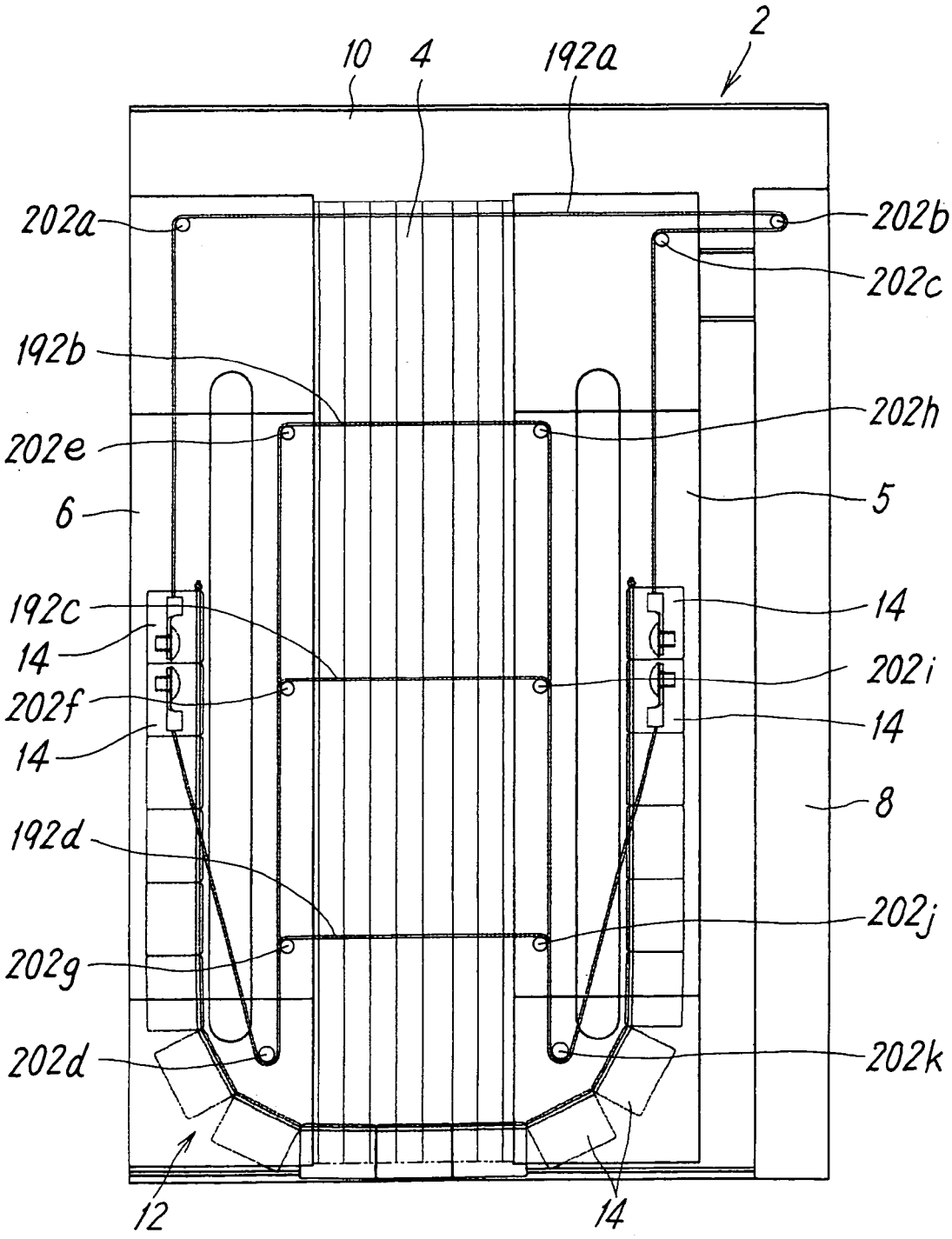
FIG. 14 is an elevational view of the overall structure of a horizontal-drawing screen door according to a third embodiment of the present invention.

A horizontal-drawing screen door shown in FIG. 14, according to a third embodiment has a structure in which the net guide 12 moves in and out the insides of the vertical frame member 6 and the movable edge member 5 fixed to both ends of the net 4 from the respective lower ends and has tension strings, which will be described later, connected to both ends thereof without being fixed to any of the vertical frame member 6 and the movable edge member 5. Such an embodiment allows the net guide 12 to have a longer total length, thereby achieving a longer open-close length of the net 4.

Also, in this horizontal-drawing screen door, stretching four tension strings 192*a* to 192*d*, for example, between the screen-door frame 2 and the movable edge member 5 configures a parallel translation mechanism of the movable edge member.

The first tension string 192*a* has its one end fixed to the guide piece 14 located at the front of the side of the net guide 12, configured to move in and out the inside of the vertical frame member 6, is guided upwards in the vertical frame member 6, then, turned by a turning piece 202*a*, extends through the net 4 and the movable edge member 5 within the horizontal frame member 10 of the screen-door frame 2 so as to be guided to the upper end of the vertical frame member 8, is wound up on a turning piece 202*b* disposed at the upper end of the vertical frame member 8 so as to be guided in the horizontal frame member 10 in the reverse direction, guided in the movable edge member 5, turned by a turning piece 202*c* at the upper end so as to be guided downwards, and connected to the end of the side of the net guide 12, configured to move in and out the inside of the movable edge member 5.

At the same time, the second to fourth tension strings 192*b* to 192*d* have respective one ends fixed to the end of the side of the net guide 12, configured to move in and out the inside of the vertical frame member 6, are guided downwards in the vertical frame member 6, wound up on a turning piece 202*d* located at the lower end of the vertical frame member so as to be guided upwards in the vertical frame member 6, then, respectively turned by turning pieces 202*e*, 202*f*, and 202*g* located at the upper, central and lower parts of the net 4 so as to extend through the net 4 through the corresponding parts, guided downwards in the movable edge member 5, further downwards respectively by turning pieces 202*h*, 202*i*,and 202*j*, subsequently, guided upwards in the movable edge member 5 by a turning piece 202*k*, and connected to the end of the side of the net guide 12, configured to move in and out the inside of the movable edge member 5.

Figure 15:
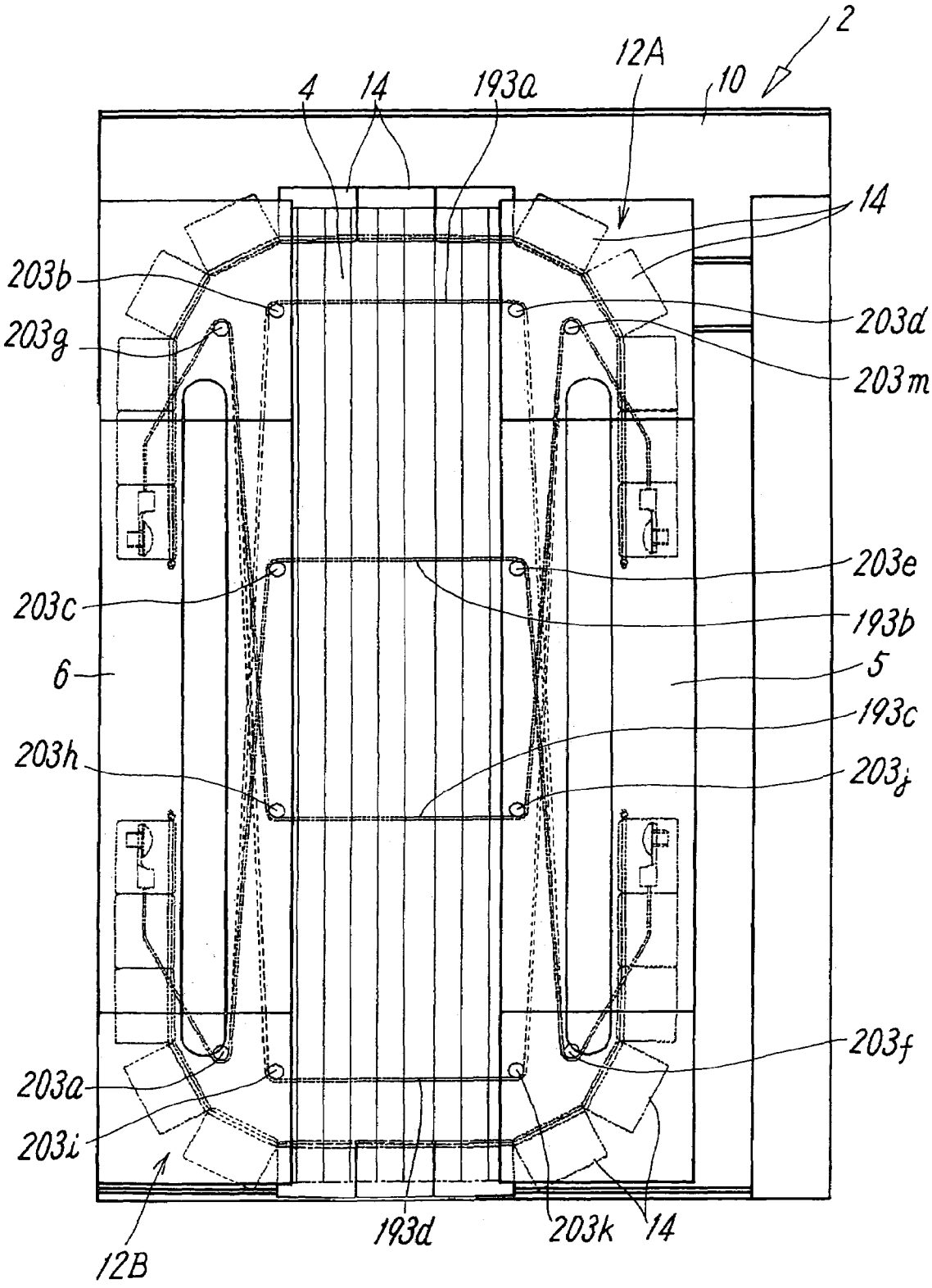
FIG. 15 is an elevational view of the overall structure of a horizontal-drawing screen door according to a fourth embodiment of the same.

In addition to the structure in the third embodiment, a horizontal-drawing screen door shown in FIG. 15, according to a fourth embodiment includes two net guides 12A and 12B configured to guide the upper and lower ends of the net 4. While these net guides are not different from that in the third embodiment, a parallel translation mechanism is slightly different from that in the third embodiment, as will be described below.

More particularly, in the horizontal-drawing screen door according to the fourth embodiment, the parallel translation mechanism of the movable edge member is configured by stretching four, i.e., first to fourth tension strings 193*a* to 193*d*.

The first and second tension strings 193*a* and 193*b* are fixed to the end of the side of the net guide 12B, configured to guide the lower end of the net 4 and move in and out the inside of the vertical frame member 6, guided downward in the vertical frame member 6, wound up on a turning piece 203*a* located at the lower end of the same so as to be guided upwards in the vertical frame member 6, then, respectively turned by turning pieces 203*b* and 203*c* at the upper and central parts of the net 4, extend through the corresponding parts of the net 4 so as to be guided to the inside of the movable edge member 5, further guided downwards in the movable edge member 5 respectively by turning pieces 203*d* and 203*e*, subsequently, upwards in the movable edge member 5 by a turning piece 203*f*, and connected to the end of the side of the net guide 12B, configured to move in and out the inside of the movable edge member 5.

The third and fourth tension strings 193*c* and 193*d* have respective one ends fixed to the end of the side of the net guide 12A, configured to guide the upper end of the net 4 and move in and out the inside of the vertical frame member 6, are guided upwards in the vertical frame member 6, wound up on a turning piece 203*g* located at its upper end so as to be guided downwards in the vertical frame member 6, then, respectively turned by turning pieces 203*h* and 203*i* located at the central lower and lower parts of the net 4 so as to extend through the corresponding parts, guided to the inside of the movable edge member 5, further upwards in the movable edge member 5 respectively by turning pieces 203*j* and 203*k*, subsequently, downwards in the movable edge member 5 by a turning piece 203*m*, and connected to the end of the side of the net guide 12A, configured to move in and out the inside of the movable edge member 5.

Meanwhile, if the net guides moving in and out the insides of the vertical frame member 6 and the movable edge member 5 from the respective ends are provided as in the third and fourth embodiments, the net guides preferably include stoppers or the like if needed, for preventing their ends from getting out from the vertical frame member 6 and the movable edge member 5.

Figure 16:
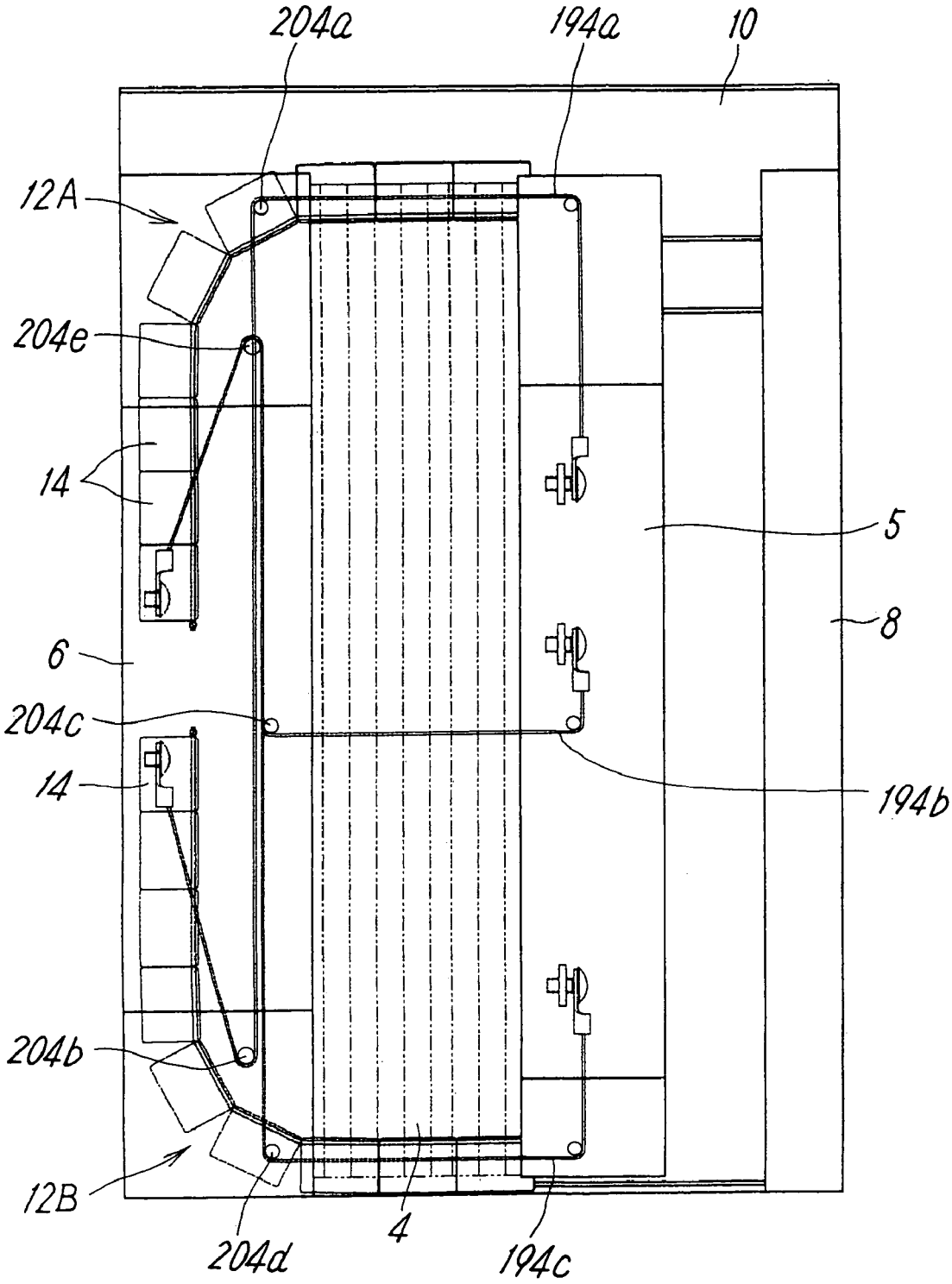
FIG. 16 is an elevational view of the overall structure of a horizontal-drawing screen door according to a fifth embodiment of the same.

A horizontal-drawing screen door shown in FIG. 16, according to a fifth embodiment has a structure in which the movable edge member 5 has the net guides 12A and 12B respectively fixed to the upper and lower ends thereof, and the net guides 12A and 12B respectively move in and out the inside of the vertical frame member 6 from its upper and lower ends in accordance with movement of the movable edge member 5. The net guides themselves are not different from the foregoing embodiments.

In the horizontal-drawing screen door shown in FIG. 16, by stretching three tension strings 194*a* to 194*c*, for example, between the screen-door frame 2 and the movable edge member 5, a parallel translation mechanism of the movable frame is configured.

The first tension string 194*a* has its one end fixed to the upper part of the movable edge member 5, extends through the net 4 and up to the inside of the vertical frame member 6, is turned downwards in the vertical frame member 6 by a turning piece 204*a*, then, wound up on a turning piece 204*b* disposed at the lower part of the vertical frame member 6 so as to be guided upwards in the vertical frame member 6, and connected to the guide piece 14 located at the front of the side of the net guide 12B guiding the lower end of the net 4, configured to be guided in and out the inside of the vertical frame member 6.

At the same time, the second and third tension strings 194*b* and 194*c* have one ends respectively fixed to the central and lower parts of the movable edge member 5, extend through the net 4 up to the inside of the vertical frame member 6, then, are turned upwards in the vertical frame member 6 respectively by turning pieces 204*c* and 204*d*, further wound up on a turning piece 204*e* disposed at the upper part of the vertical frame member 6 so as to be guided downwards in the vertical frame member 6, and connected to the guide piece 14 located at the front of the side of the net guide 12A guiding the upper end of the net 4, configured to be guided in and out the inside of the vertical frame member 6.

Figure 17:
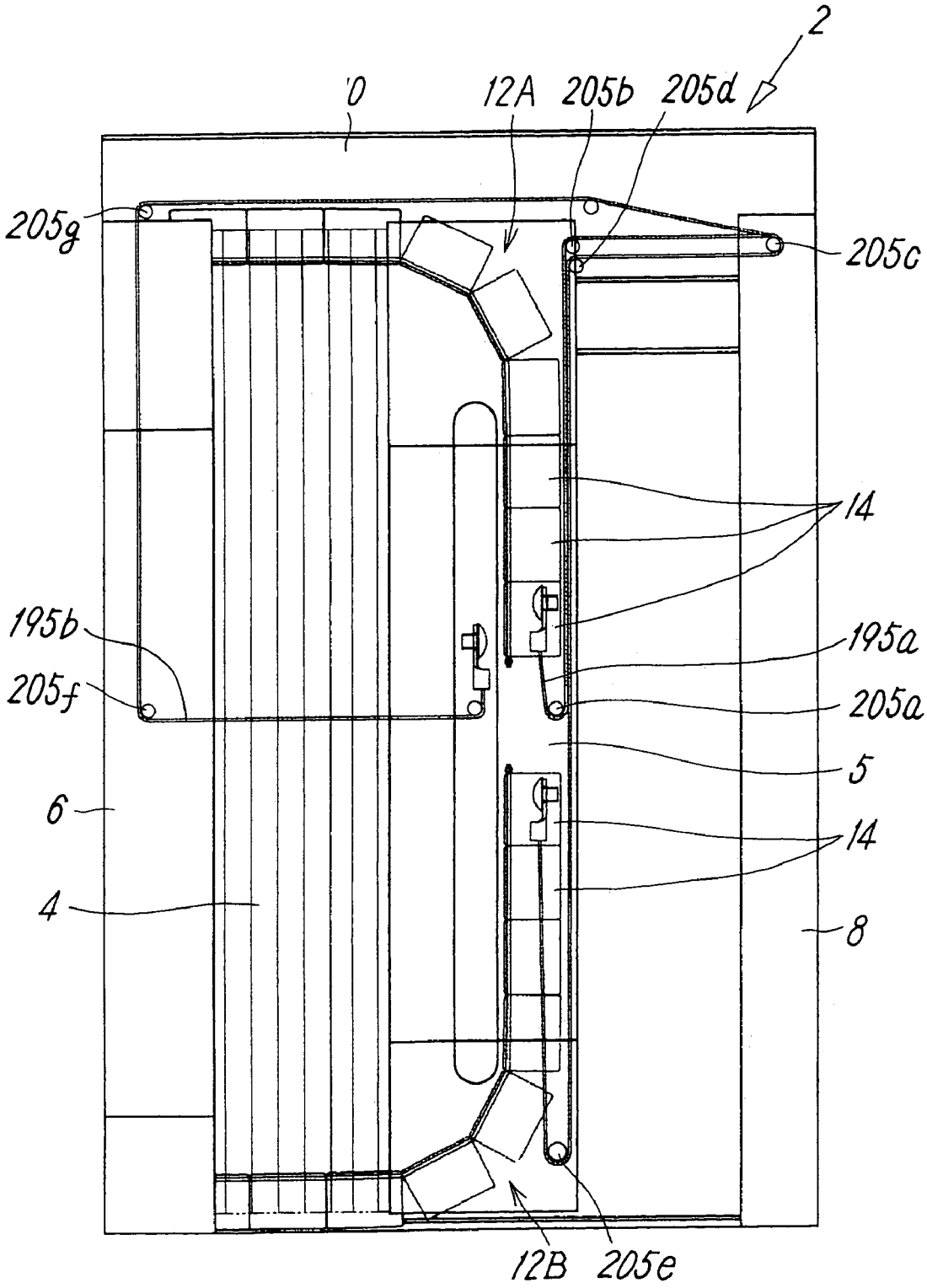
FIG. 17 is an elevational view of the overall structure of a sixth embodiment of the same.

A horizontal-drawing screen door shown in FIG. 17, according to a sixth embodiment has a structure in which the net guides 12A and 12B have one ends respectively fixed to the upper and lower ends of the vertical frame member 6 having one end of the net 4 fixed thereto, the fronts thereof are guided in the movable edge member 5 from its upper and lower ends, and these guides move in and out the inside of the movable edge member 5 in accordance with movement of the movable edge member 5.

Also, in the horizontal-drawing screen door according to the sixth embodiment, by stretching two tension strings 195*a* and 195*b*, for example, between the screen-door frame 2 and the movable edge member 5, a parallel translation mechanism of the movable edge member 5 is configured.

The first tension string 195*a* has its one end fixed to the guide piece 14 located at the front of the side of the net guide 12A, configured to move in and out the inside of the movable edge member 5 from its upper end, is guided downwards, then, wound up on a turning piece 205*a* so as to be guided to the upper end of the movable edge member 5, subsequently, guided to the inside of the vertical frame member 8 by a turning piece 205*b* through the upper horizontal frame member 10, wound up there on a turning piece 205*c* so as to be guided in the horizontal frame member 10 in the reverse direction, subsequently, guided again to the inside of the movable edge member 5, turned downwards in the movable edge member 5 by a turning piece 205*d*, wound up on a turning piece 205*e* disposed at the lower end of the movable edge member 5 so as to be guided upwards in the movable edge member 5, and connected to the guide piece 14 located at the front of the side of the net guide 12B, configured to move in and out the inside of movable edge member 5.

At the same time, the second 195*b* has its one end fixed to the central part of the movable edge member 5, extends through the net 4 so as to be guided to the inside of the vertical frame member 6, then, is turned by a turning piece 205*f* so as to be guided in the vertical frame member 6 and up to the inside of the horizontal frame member 10 placed at its upper part, turned by a turning piece 205*g* provided there so as to extend in the horizontal frame member 10, guided to the inside of the vertical frame member 8, turned up there on the turning piece 205*c* so as to be guided together with the first tension string 195*a* in the horizontal frame member 10 in the reverse direction, then, guided to the inside of the movable edge member 5, further turned by the turning piece 205*d* so as to be guided downwards in the movable edge member 5, turned up on the turning piece 205*e* disposed at the lower end of the movable edge member 5 so as to be guided upwards in the movable edge member 5, and is connected to the guide piece 14 located at the front of the net guide 12B configured to move in and out the inside of the movable edge member 5 from its lower end.

Figure 18:
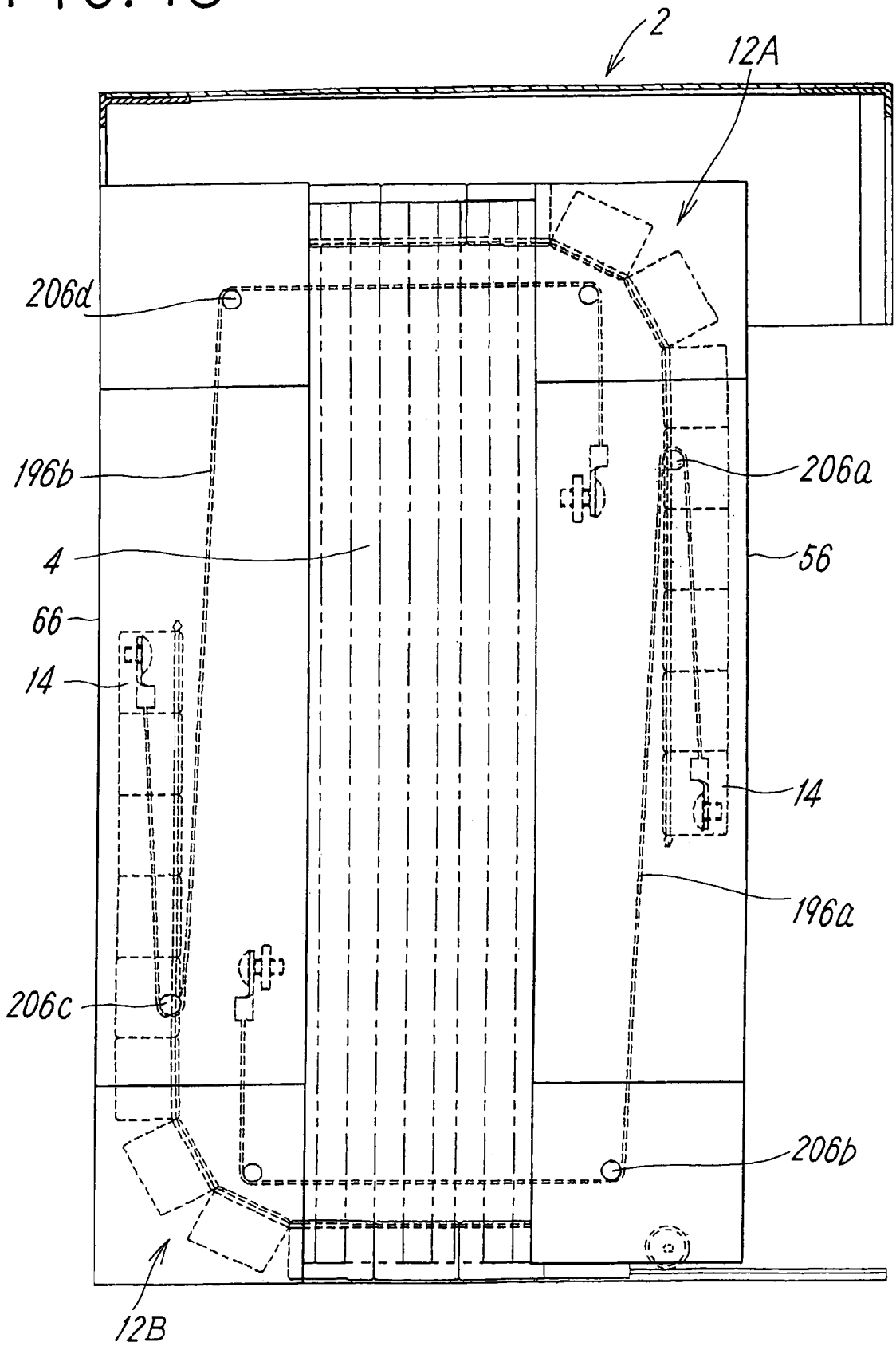
FIG. 18 is an elevational view of the overall structure of a horizontal-drawing screen door according to a seventh embodiment of the same.

A horizontal-drawing screen door shown in FIG. 18, according to a seventh embodiment has a structure in which, the net guide 12A has one end fixed to the upper end of the vertical frame member 6, fixed to one side of an opening of a building and having one end of the net 4 fixed thereto, so as to allow the front thereof to be guided in the movable edge member 5 from its upper end, also, the front of the net guide 12B has one end fixed to the lower end of the movable edge member 5 so as to allow the front thereof to be guided in the vertical frame member 6 from its lower end, thus, in accordance with movement of the movable edge member 5, the net guide 12A moves in and out the inside of the movable edge member 5 from its upper end, and, at the same time, the net guide 12B moves in and out the inside of the vertical frame member 6 from its lower end. Meanwhile, no member corresponding to the vertical frame member 8 in the foregoing embodiments is provided.

In the horizontal-drawing screen door according to the seventh embodiment, by stretching two tension strings 196*a* and 196*b*, for example, between the screen-door frame 2 and the movable edge member 5, a parallel translation mechanism of the movable edge member is configured.

The first tension string 196*a* has its one end fixed to the guide piece 14 located at the front of the net guide 12A, configured to move in and out the inside of the movable edge member 5 from its upper end, is guided to the upper part of the movable edge member 5, then, wound up on a turning piece 206*a* provided at the upper part so as to be guided downwards in the movable edge member 5, turned by a turning piece 206*b* located at its lower end, extends through the lower part of the net 4 so as to be guided to the inside of the vertical frame member 6, and is fixed to the lower part in the vertical frame member 6.

At the same time, the second tension string 196*b* have respective one ends fixed to the guide piece 14 located at the front of the net guide 12B, configured to move in and out the inside of the vertical frame member 6 from its lower end, is guided downwards in the vertical frame member 6, wound up on a turning piece 206*c* disposed at its lower part so as to be again guided upwards, turned by a turning piece 206*d* disposed at its upper part, extends through the upper part of the net 4 so as to be guided to the movable edge member 5, and is fixed to its upper part.

The ways of winding around the tension strings configuring the parallel translation mechanisms of the movable edge members described in the first to seventh embodiments by way of example are not limited to the above-described ways, and, for example, the arrangement of the net guide(s) to be guided in and out any frame member(s) of the screen door can be appropriately modified depending on the structure of the horizontal-drawing screen door.

Figure 19:
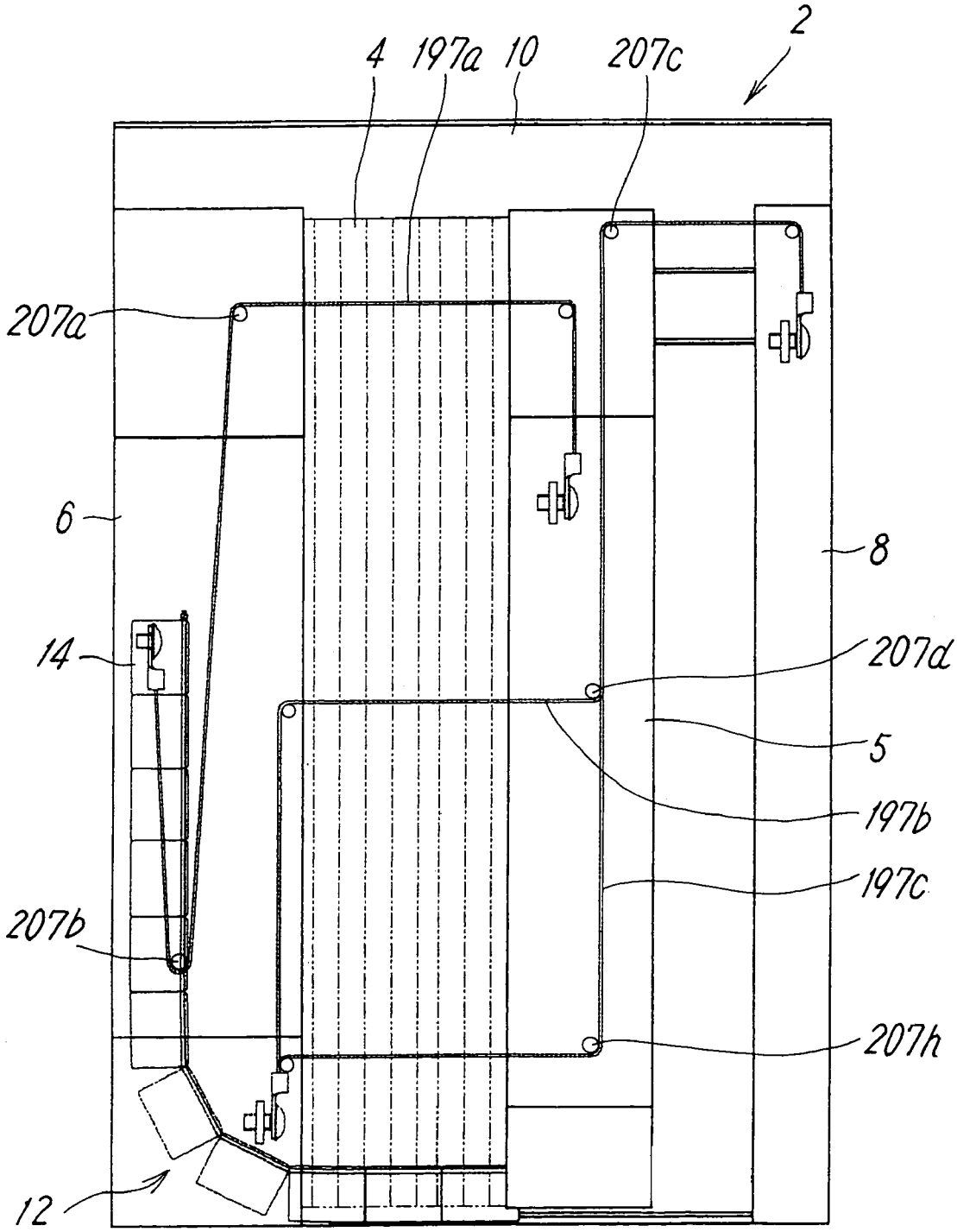
FIG. 19 is an elevational view of the overall structure of an eighth embodiment of the same.

For example, a horizontal-drawing screen door shown in FIG. 19 by way of example, according to an eighth embodiment has a structure in which, although the arrangement of the net guide 12 is the same as that in the horizontal-drawing screen door according to the first embodiment shown FIG. 1, the way of winding around strings constituting a parallel translation mechanism is different from that in the first embodiment.

In the horizontal-drawing screen door according to the eighth embodiment, by stretching three tension strings 197*a* to 197*c*, the parallel translation mechanism of the movable edge member 5 is configured.

The first tension string 197*a* has its one end fixed to the upper part of the movable edge member 5, extends through the net 4 so as to be guided to the inside of the vertical frame member 6, is turned by a turning piece 207*a* so as to be guided down in the vertical frame member 6, then, wound up on a turning piece 207*b* located at the lower part of the vertical frame member 6 so as to be guided upwards in the vertical frame member 6, and connected to the guide piece 14 located at the front of the side of the net guide 12, configured to be guided in and out the inside of the vertical frame member 6. The way of winding around of the first tension string 197*a* is the same as that in the first tension string 19*a* in the first embodiment.

Also, while the second and third tension strings 197*b* and 197*c* have respective one ends fixed to the upper part of the vertical frame member 8, are guided to the upper end of the movable edge member 5 and turned at the upper end by a turning piece 207*c* so as to be guided downwards in the movable edge member 5, the second and third tension string 197*b* and 197*c* are respectively turned at the central and lower parts of the movable edge member 5 by turning pieces 207*d* and 207*e*, extend through the net 4 so as to be guided to the inside of the vertical frame member 6, and are fixed to the vertical frame member 6.

As long as the attitude of the movable edge member 5 can be maintained or a parallel translation of the movable edge member 5 is stably achieved, the tension strings configuring the parallel translation mechanism can be stretched in an arbitrarily winding around manner as described above.

While a variety of use patterns of net guides of the horizontal-drawing screen doors, each including the net 4 extendable in an accordion-like manner, according to the embodiments, have been described above, the present invention is limited neither to the screen device including the foregoing net 4 extendable in an accordion-like manner nor to the horizontal-drawing screen door, and targeted to horizontal-drawing screen doors including a variety of sheet members formed such that each member extended in a sheet-like pattern can be stored in a unit by folding, winding up, stacking, or the like.

Figure 20:
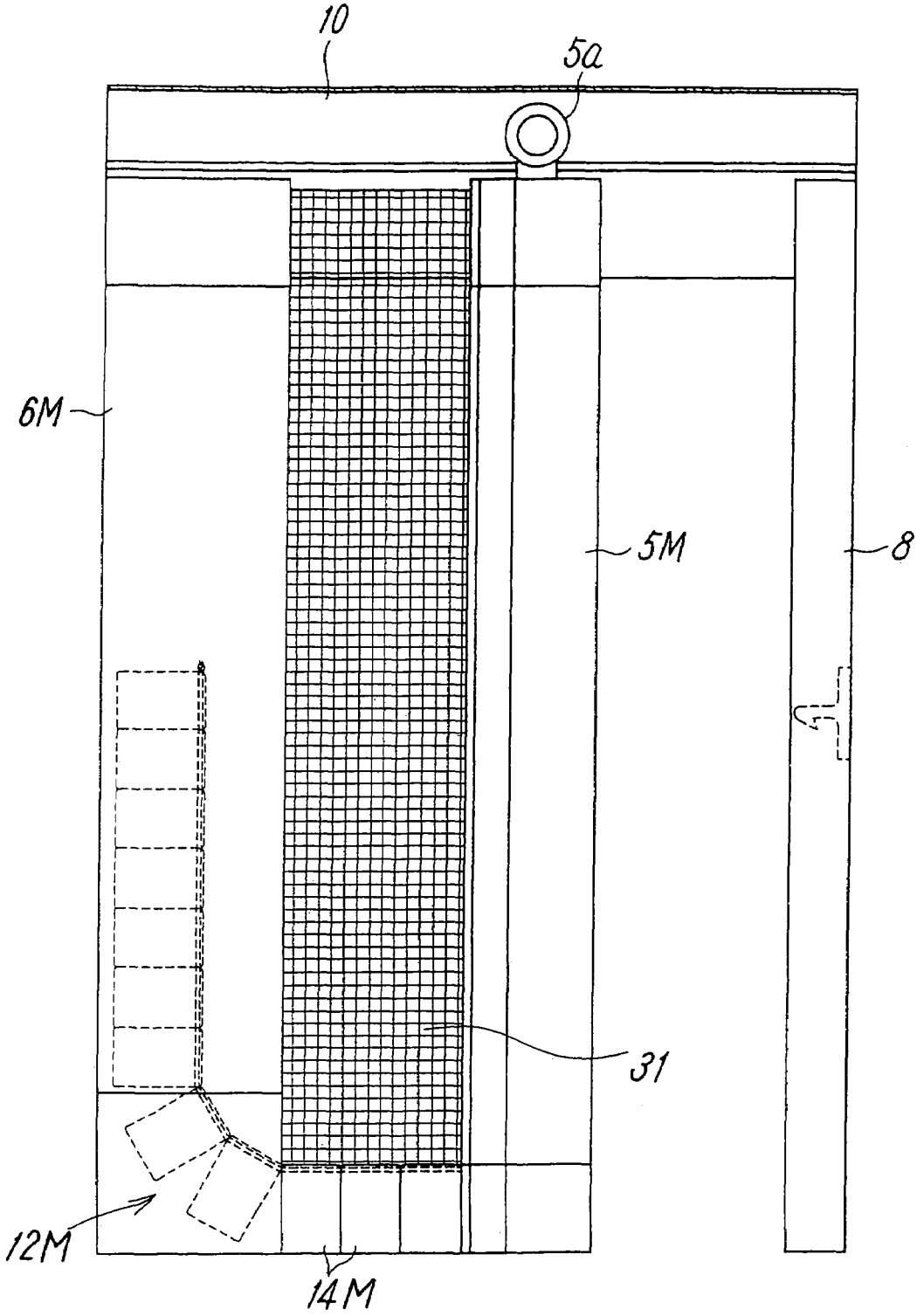
FIG. 20 is an elevational view of the overall structure of a roll-type horizontal-drawing screen door according to a ninth embodiment of the present invention.
Figure 21:
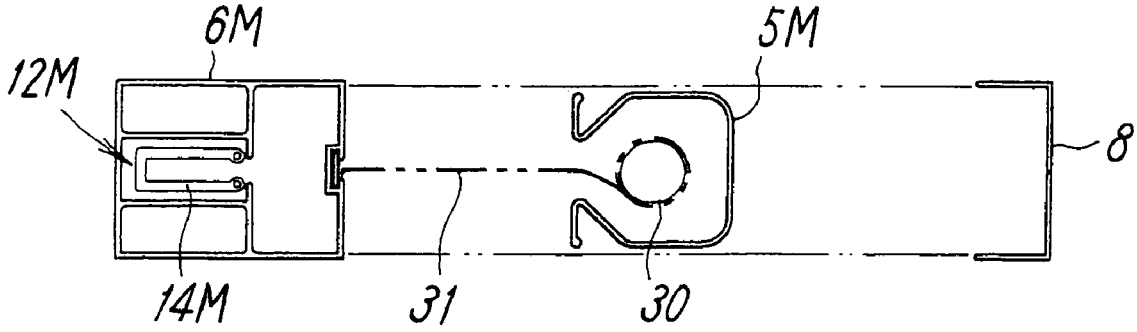
FIG. 21 is a sectional plan view of FIG. 20.
Figure 22:
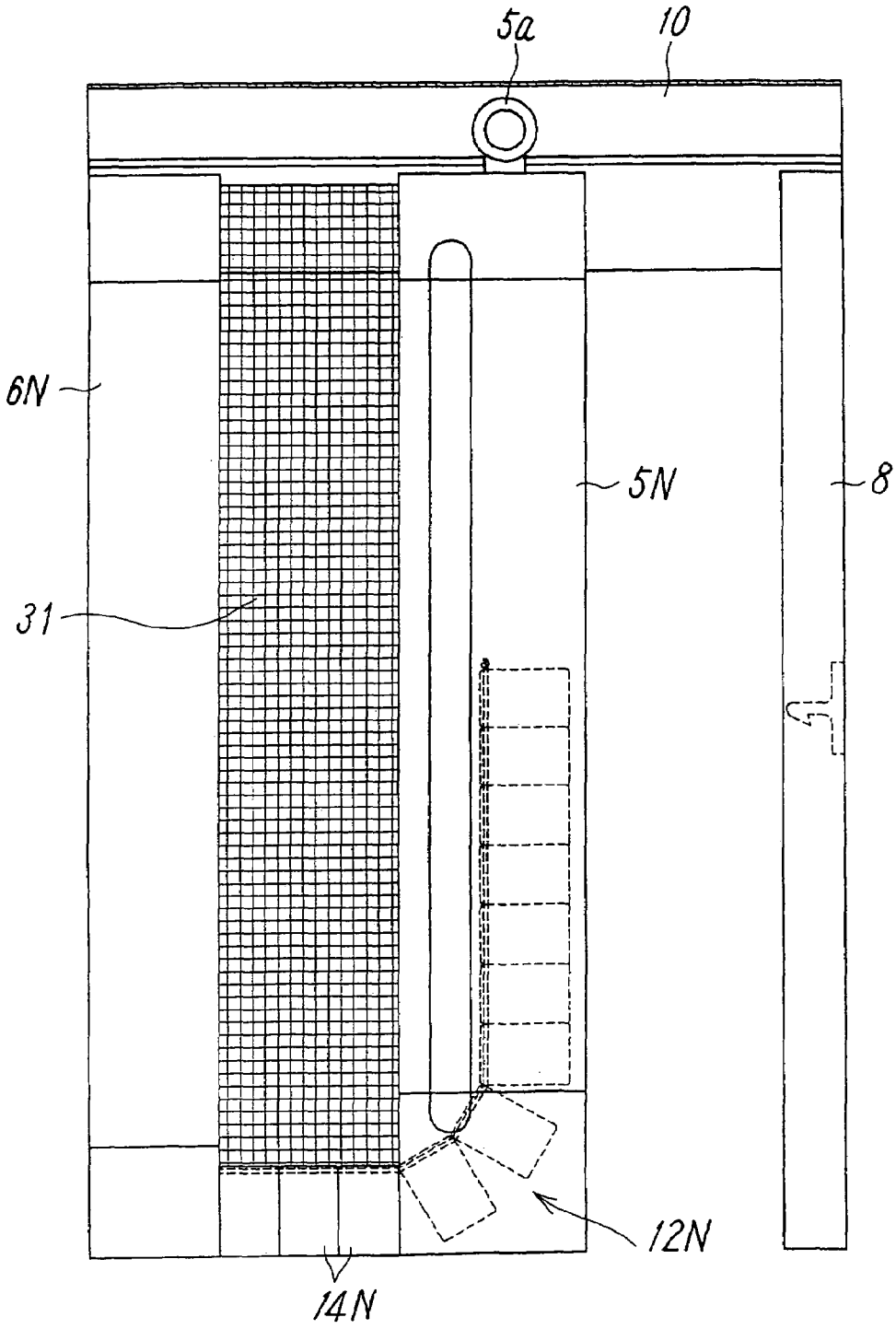
FIG. 22 is an elevational view of the overall structure of a roll-type horizontal-drawing screen door according to a tenth embodiment of the present invention.
Figure 23:
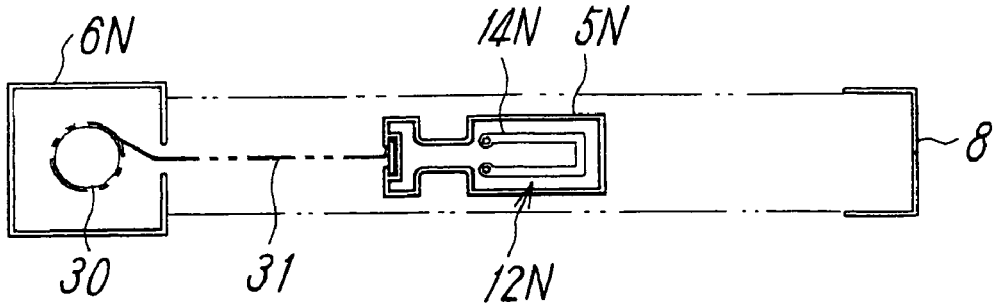
FIG. 23 is a sectional plan view of FIG. 22.

For example, the present invention is applicable to a screen device shown in FIGS. 20 and 21 or another screen device shown in FIGS. 22 and 23, including a screen 31 such as a flexible light-shielding screen wound around a winding shaft 30, or any one of a variety of sheets and fly nets.

In a ninth embodiment shown in FIGS. 20 and 21, the winding shaft 30 configured to take up the screen 31 with an urging force of a spring disposed in the shaft is rotatably accommodated in a movable edge member 5M, the other end of the screen 31 is fixed to a vertical frame member 6M, the movable edge member 5M is suspended from the upper horizontal frame member 10 with a roller 5*a* disposed at its upper end, and a screen guide 12M having one end fixed to the lower end of the movable edge member 5M is guided in and out the vertical frame member 6M from its lower end. While the screen guide 12M can have substantially the same structure as that shown in FIGS. 4 to 11, in the present embodiment, a guide piece 14M has a small width as shown in the figure.

Also, in a tenth embodiment shown in FIGS. 22 and 23, the winding shaft 30 the same as that in the ninth embodiment is accommodated in a vertical frame member 6N, the other end of the screen 31 is fixed to a movable edge member 5N, and the movable edge member 5N is likewise suspended from the horizontal frame member 10 with the roller 5*a*. With this, a screen guide 12N having its one end fixed to the lower end of the vertical frame member 6N is guided in and out the movable edge member 5N from its lower end. A guide piece 14N is substantially the same as the guide piece 14M in the ninth embodiment.

In the meantime, the screen device according to the present invention, especially those in the ninth and tenth embodiments, can be of not only the horizontal-drawing type described in the foregoing embodiments but also a vertical-drawing type.

The invention claimed is:

1. A screen device comprising:

a pair of elongated frame members which extend parallel to each other and are movable such that a space between them is able to expand and shrink;

a screen having ends attached to said frame members and which is opened and closed when expanding and shrinking the space between said frame members; and an elongated bendable screen guide which moves in or out of one of the frame members in response to an open or close operation of said screen, wherein the screen guide is able to bend by a right angle to extend along one of the ends of the screen when the screen is stretched to an open state, wherein said screen guide includes a plurality of guide pieces aligned in a row such that contact surfaces of adjacent ones of said guide pieces contact each other, and a flexible wire member connects all of the guide pieces to each other, wherein said guide pieces are composed of a synthetic resin and each have a cross section formed in an approximately U-shape whose bottom wall is aligned along one of the ends of the stretched screen, and a pair of standing walls respectively aligned along front and back surfaces of the stretched screen, wherein a top part of each of said standing walls has a passage hole penetrating along the aligned direction of said guide pieces, and wherein said wire member extends through said passage holes to serially connect said guide pieces with adjacent ones of the guide pieces such that the contact surfaces of the adjacent guide pieces contact each other when the screen guide is guided along the end of the stretched screen.

2. The screen device according to claim 1, further comprising grooves in said standing walls for allowing said wire members to be fitted in and detached from said passage holes.

3. The screen device according to claim 1, further comprising intermediate rotors interposed between the passage holes of adjacent guide pieces, wherein said wire members pass through the intermediate rotors.

4. The screen device according to any of claims 1-3, further comprising a guide rail for guiding said screen guide along the end of the stretched screen, wherein at least some of the guide pieces include engagements slidably engaging with said guide rail.

5. A screen device according to claim 1, wherein the screen is extendably formed in an accordion-like shape having a plurality of pleats which are alternately folded back and forth.

6. The screen device according to claim 5, wherein the screen guide moves in or out of the inside of said pair of frame members.

7. The screen device according to claim 1, wherein said screen is formed in a flexible sheet-like form, and wherein a winding axis for winding said sheet is aligned along the axial direction of one of said frame members and inside the one of said frame members.

8. The screen device according to any of claims 5-7, wherein said pair of frame members is installed in a standing manner in a vertical direction and is openable in a transverse direction.

9. The screen device according to any of claims-5-7, wherein said pair of frame members is installed in a standing manner in a vertical direction and is openable in a transverse direction, and one of said screen guides is provided at both of upper and lower ends of said extended screen.

10. The screen device according to claim 5, wherein said pair of frame members is installed in a standing manner in a vertical direction and is openable in a transverse direction, further comprising a parallel translation mechanism for keeping the parallel state of the frame members when expanding and shrinking the space between said pair of frame members, wherein said parallel translation mechanism includes a tension string having one end connected to said screen guide and extending between said pair of frame members.

11. The screen device according to any of claims 5-7, wherein the screen is formed by an insect-proof net.

* * * * *